US005642462A

United States Patent [19]

Huff

[11] Patent Number: 5,642,462

[45] Date of Patent: Jun. 24, 1997

[54] FABRIC ARTICLE DRYING RACK ASSEMBLY MOUNTABLE TO A SUPPORT ASSEMBLY UTILIZING HEATED AIR FLOW

[75] Inventor: Gary D. Huff, Marcellus, Mich.

[73] Assignee: Lyons Industries, Inc., Dowagiac, Mich.

[21] Appl. No.: 289,786

[22] Filed: Aug. 12, 1994

[51] Int. Cl.[6] ..... A47K 10/06; F26B 9/00; F24H 3/00

[52] U.S. Cl. ..... 392/382; 392/381; 219/521; 219/385; 34/622; 34/621; 211/96

[58] Field of Search ..... 34/619, 621, 622, 34/202, 232, 233; 219/521, 385; 392/379, 382, 383, 381, 363, 370; 223/51; 211/87, 96, 105.1; 248/214, 222.3, 251

[56] References Cited

U.S. PATENT DOCUMENTS

| | | | |
|---|---|---|---|
| 1,280,244 | 10/1918 | Kroedel | 248/251 |
| 1,440,402 | 1/1923 | Meredith-Jones . | |
| 1,677,280 | 7/1928 | Gilbert | 219/521 |
| 2,374,787 | 5/1945 | Spiegel et al. | 248/251 |
| 2,606,667 | 8/1952 | Hornick | 248/251 |
| 2,668,368 | 2/1954 | Jacobs . | |
| 2,835,049 | 5/1958 | Jacobs | 34/621 |
| 2,856,700 | 10/1958 | Wales | 34/232 |
| 3,160,734 | 12/1964 | Rylander | 219/521 |
| 4,094,076 | 6/1978 | Baslow | 34/90 |
| 4,117,309 | 9/1978 | Cayley | 219/385 |
| 4,558,526 | 12/1985 | Baus | 34/232 |
| 5,467,423 | 11/1995 | Jakubowski | 392/379 |

FOREIGN PATENT DOCUMENTS

| | | | |
|---|---|---|---|
| 128751 | 8/1948 | Australia | 219/521 |
| 2442584 | 3/1976 | Germany | 34/621 |
| 505769 | 12/1954 | Italy | 248/222.3 |
| 283591 | 10/1952 | Switzerland | 392/379 |
| 353841 | 1/1930 | United Kingdom | 219/521 |
| 638203 | 6/1950 | United Kingdom | 219/521 |
| 1217503 | 12/1970 | United Kingdom | 248/222.3 |
| 9203960 | 3/1992 | WIPO . | |

*Primary Examiner*—John A. Jeffery
*Attorney, Agent, or Firm*—Fitch, Even, Tabin & Flannery

[57] ABSTRACT

A rack assembly for drying and warming fabric articles which includes an elongated tube having an interior chamber housing an electrical dryer for warming the air and directing the air through the tube and over a plurality of elongated slots formed in the elongated tube to expel the air onto the fabric article. The slots may increase in length preceding away from the dryer and cooperate with a divider wall angling down preceding away from the dryer to reduce the transverse cross-section of the interior chamber to provide a uniform forced air flow from the elongated tube onto the fabric article. The elongated tube may further comprise a plurality ribs on its exterior for spacing the fabric article from the elongated slots. The rack assembly may be mounted to an existing towel rack bar by having openings at each end and a removable cover to extend to bar of the existing rack through the assembly and out the openings. The rack assembly may also be mounted directly to a wall by using removable end caps and wall mount brackets.

48 Claims, 5 Drawing Sheets

FABRIC ARTICLE DRYING RACK ASSEMBLY MOUNTABLE TO A SUPPORT ASSEMBLY UTILIZING HEATED AIR FLOW

FIELD OF THE INVENTION

The present invention is directed to providing a rack assembly for fabric articles and, more particularly, to providing a rack assembly for warming and drying fabric articles with heated air.

BACKGROUND OF THE INVENTION

A variety of racks have been developed for air drying damp fabric articles. Such racks are commonly found in kitchens and bathrooms. In conventional form, racks traditionally include a bar mounted to a wall with brackets for allowing damp fabric articles, such as towels, undergarments, hosiery and like, to be hung for drying. These conventional racks fail to facilitate rapid drying. As a result, fabric articles tend to pile up or compete for space on the conventional rack and remain on the rack until dried naturally by the surrounding atmosphere.. Thus, there is a need for a rack which increases drying time so that newly damp fabric articles can be hung for drying without waiting for previous damp articles to dry or without piling them on top of the previous hung damp articles Conventional racks also lack the ability to warm fabric articles which may already be dry. Experience has revealed that it is desirable to have a warm towel after washing or showering. For instance, the touch of a freshly warmed towel is pleasant after washing or showering, especially so in cold weather climates. Thus, there in also a need for a rack assembly that not only facilitates enhanced drying of fabric articles, but that also warms them beyond ambient temperatures.

To accelerate the drying and to warm fabric articles, known solutions include blowing heated air across the fabric article while it hangs from the rack. For example, U.S. Pat. No. 4,094,076, issued to Baslow (Baslow '076), discloses a fixture serving as a storage holster for a portable hair dryer and also functioning as a rack for drying and warming towels and the like. More particularly, the fixture includes a vertical holster section having at one end an open socket for receiving the nozzle of a conventional portable hair dryer. The lower end of the holster section connects to a horizontal hollow rack section having perforations therealong. The interior of the holster section and the rack section communicate so that hot air from the hair dryer is eventually emitted from the rack section through the perforations onto the fabric article.

One known shortcoming with the fixture disclosed in Baslow '076 includes the standard hair dryer necessary to provide the warm air. It is desirable to provide an improved rack with enhanced drying and warming capability without requiring an external hair dryer. That is, the rack must be a self-contained unit having its own internal mechanical components.

Another known shortcoming is that the fixture disclosed by Baslow '076 consumes an undesirable amount of space in that it has both the holster section and the rack section extending perpendicular from one another. It is desirable that the rack only consume space similar to that necessary for a conventional rack. Thus, it is desirable that the means for providing warm air does not unduly enlarge the rack.

One attempt at alleviating the above shortcomings is disclosed in U.S. Pat. No. 2,668,368, issued to Jacobs (Jacobs '368). More specifically, Jacobs '076 discloses a rack having vertically spaced, parallel support bars mounted to the wall by housings at each end. One of the housings contains an electric motor and fan for directing air over heating elements and then into each of the bars. The bars include outlet openings enabling the air to exit the bars onto a fabric article supported by one of the bars.

One known shortcoming with the rack disclosed in Jacobs '368 relates to its undesirable size resulting from the housing units employed to support and attach the bars to the wall and to house the devices to provide warm air. As already mentioned, it is desirable that the rack assembly be a self-contained compact unit with virtually a conventional rack-like silhouette.

A further shortcoming of the rack disclosed in Jacobs '368 pertains to the bars for supporting the fabric article. The bars disclosed in Jacobs '368 are narrow and do not spread the fabric article portions draped over each side of the bar sufficiently to allow for drying or warming of the lower portions of the fabric article. Only the portions of the fabric article at the rack bars and the bars immediate vicinity are ensured to be dried or warmed. In order to ensure complete warming and drying, the fabric article would have to be left for an undesirable length of time. This is especially the case with a longer fabric article, such as a bath or beach towel. Thus, it is further desirable that the rack provide sufficient spacing between the towel portions draped over each side of the rack bar to ensure that the lower portions are affected.

Another even further known shortcoming of the rack disclosed in Jacobs '368 rack pertains to the flow of the air in the bars and out the perforations. The disclosed perforations and internal chamber of the bars do not facilitate forced air flow at the remote ends of the bars under certain conditions. For instance, under certain air supply flows to the bar, the air emitting from the perforations at the remote bar ends will be less than that at the perforations at the near end. As a result, the fabric article will not dry uniformly. Thus, it is desirable that the rack dry the fabric article uniformly in the transverse direction as well as longitudinally.

It is the primary object of the present invention to provide a rack assembly with a conventional rack-like silhouette, but further providing enhanced drying and warming capability in a single, self-contained unit.

It is another object of the present invention to provide a rack assembly which is easily mountable to either a wall or other structure or directly to an existing conventional rack.

It is a further object of the present invention to provide a rack assembly having enhanced drying and warming capability which uniformly drys and/or warms the fabric article in a more efficient and effective manner than previous devices.

An overall object of the present invention is to provide a rack assembly having all the above-mentioned objects which is highly durable, efficient and cost effective to manufacture, install and operate.

SUMMARY OF THE INVENTION

The present invention achieves the above-stated objects, as well as other advantages described herein, by means of rack assembly which is mountable to a support panel for drying fabric articles hung thereover with air. The rack assembly may comprise an elongated tube having a first and second end closure walls, an interior chamber located between the end closure walls, an outer surface capable of supporting the fabric article and a plurality of slots in the elongated tube that extend through the outer surface for emitting the air outward. The rack assembly further comprises an electric heating element located in the interior chamber for warming the air, a fan located in the interior chamber for directing the air over the electric heating element and toward the second end closure wall over the plurality of slots to force the air to exit the interior chamber an onto the fabric article. An electric motor may be provided for driving the fan and means for mounting the elongated tube to the support panel at an elevated position for enabling the fabric article to be suspended from the elongated tube adjacent the plurality of slots for drying.

Further, the rack assembly may comprise a divider wall extending longitudinally through the interior chamber toward the second end wall for reducing the cross-section of the interior chamber to facilitate forced flow of the air through the plurality of slots.

The rack assembly may further include that the plurality of slots are elongated slots spaced longitudinally along the elongated tube, and that the elongated slots may vary in length becoming shorter preceding from the first end wall to the second end wall. Also, the rack assembly may include a plurality of ribs spaced longitudinally therealong the elongated tube and extending outward from the outer surface for spacing the fabric article from the elongated slots.

The means for mounting the rack assembly to the support panel may include a first end cap mounted at the first end wall, a second end cap mounted at the second end wall, a first and second wall bracket or insert capable of being mounted to the support panel and adapted to engage the first and second end caps, respectively, and means for securing the first and second end caps to the first and second wall brackets to prevent release. Each of the end caps may be mounted to extend laterally away from the elongated tube.

Each of the end caps may be pivotally mounted to the first and second end walls for allowing each end cap to rotate from a first position in which the end cap is locked and positioned laterally from the elongated tube for receiving the wall bracket to a second position in which the end cap is free to slide relative to the elongated tube for removing the end caps. The pivotable mounts may allow at least 90 degrees of rotation to enable each end cap to rotated between the first and second positions.

The rack assembly may also include a top cover having a top exterior surface capable of supporting the fabric article, a first cover end wall and a second cover end wall, an opening in each of the cover end walls, and an opening in each of the end walls of the elongated tube. The openings of both the top cover and the elongated tube cooperate to form openings in the rack assembly through which a rack bar mounted to the support panel may extend longitudinally through the rack assembly and out the openings to support the rack assembly. Further, the top cover may be removable for placing the rack bar through the rack assembly and out the openings and may also include means for securing the top cover to the rack assembly and releasing the top cover from the rack assembly. Lock tabs extending from the elongated tube to lock in openings in the top cover may be employed to secure the top cover to the elongated tube.

DETAILED DESCRIPTION OF THE DRAWINGS

The present invention will be described in connection with the accompanying drawings, which illustrate the preferred embodiments and details of the invention, and in which.

DETAILED DESCRIPTION OF THE PREFERRED EMBODIMENT

Figure 1:
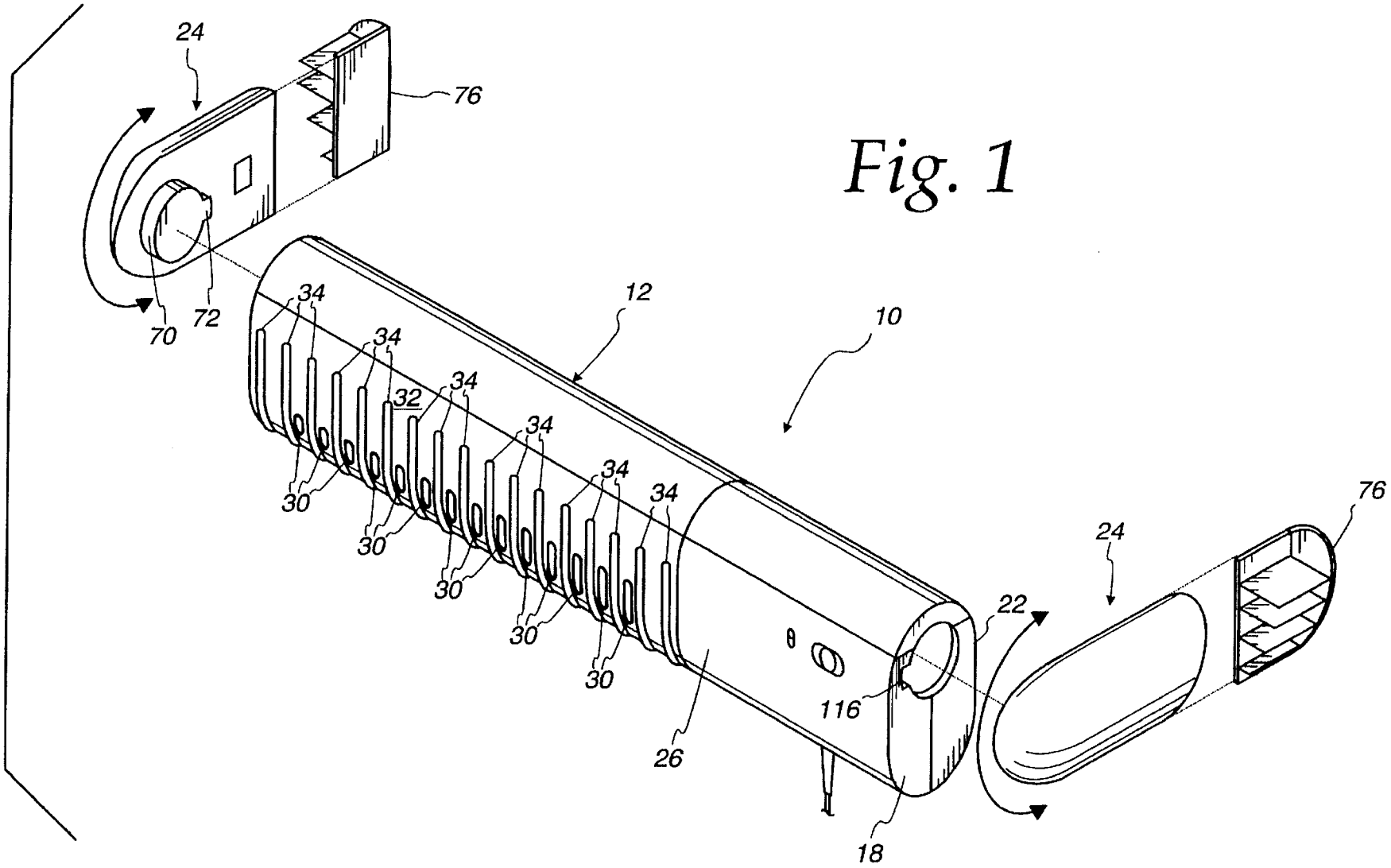
FIG. 1 is a partially exploded, perspective view of a rack assembly according to the present invention.

Referring to FIG. 1, one example of the present invention is illustrated in a rack assembly 10 emulating substantially a conventional rack-like silhouette. The rack assembly 10 is a self-contained assembly so to conserve space and includes features designed to provide enhanced uniform drying and warming of a fabric article which is hung thereover. The illustrated rack assembly 10 is commonly employed in a bathroom environment; however, it may be employed wherever there is a need for drying or warming damp fabric articles.

The rack assembly 10 comprises a substantially hollow elongated tube 12 defining an interior chamber 14 (FIG. 6) between a left end closure wall 16 and a right end closure wall 18 and an upper outer surface 20 for supporting the fabric article. The rack assembly 10 is sized similar to that of a conventional air drying rack with the exception that the elongated tube 12 has a slightly larger transverse cross-section for housing certain internal components and for positioning the fabric article, both to facilitate enhanced uniform drying and warming of the fabric article.

The rack assembly 10 may be mounted either to an existing conventional bar rack or directly to a wall. For instance, each of the end walls 16 and 18 includes an opening 22 to enable a bar of an existing rack to extend through the assembly 10 to allow the assembly 10 to be suspended from the bar of the existing rack. Alternatively, removable wall mounts 24 may be mounted to the rack assembly 10 by rotatably locking them in the openings 22 at each end wall 16 and 18 to mount the rack assembly 10 directly to the wall.

Figure 9:
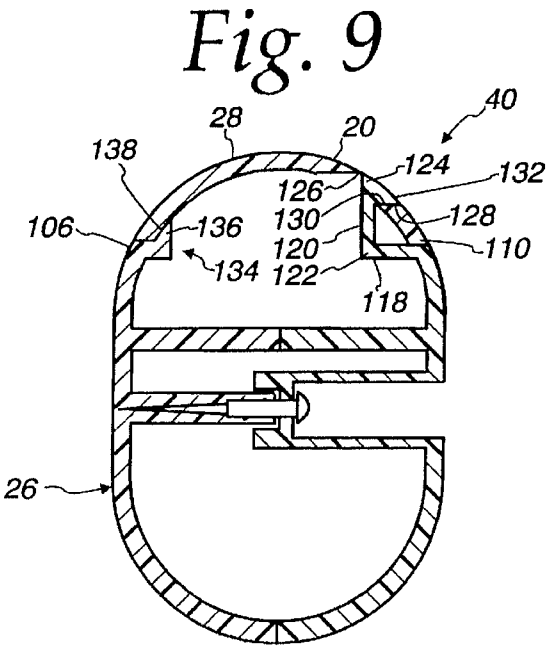
FIG. 9 is a cross-sectional view of the rack assembly taken along line 9—9 of FIG. 3.
Figure 8:
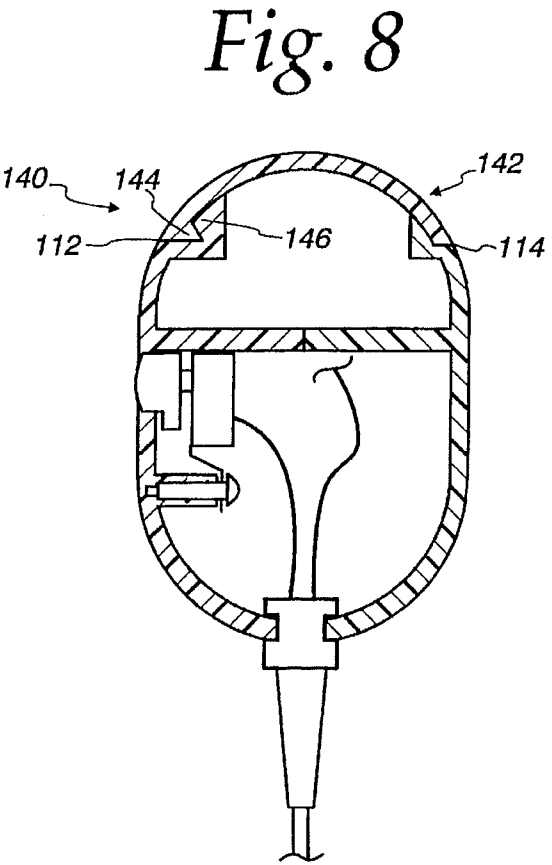
FIG. 8 is a cross-sectional view of the rack assembly taken along line 8—8 of FIG. 3.
Figure 7:
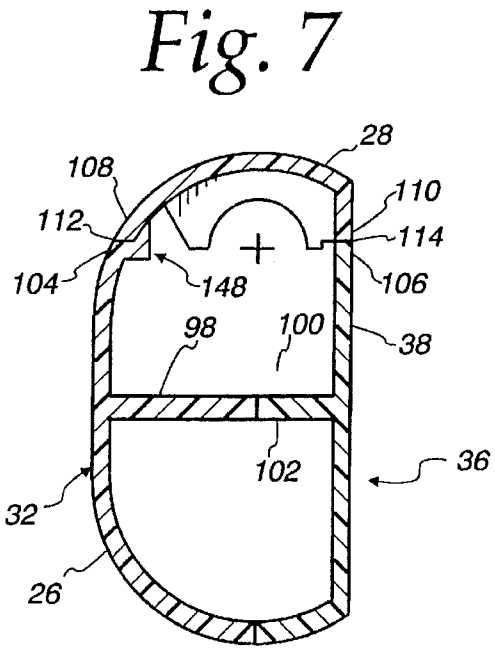
FIG. 7 is a cross-sectional view of the rack assembly taken along line 7—7 of FIG. 3.

The elongated tube 12 comprises a substantially arcuate bottom wall 26 and an arcuate removable top cover-like wall 28 which is locked to the bottom wall 26 to give the elongated tube 12 a substantially ovate cross-section (FIGS. 7–9). The top cover 28 includes the upper outer surface 20 for supporting the fabric article. The bottom wall 26 includes a plurality of equally spaced, elongated air vent slots 30 on the front side 32 of the rack assembly 10 located to direct air out of the assembly 10 and onto the fabric article. The slots 30 sequentially increase in length from left to right along the bottom wall 26 of the elongated tube 12. A plurality of ribs 34 having a vertically extending portion which then arcs around the bottom wall 26 are interspaced between the slots 30 to space the fabric article from the vent slots 30 and the bottom wall 26 to enable the air to flow from the assembly 10 downward to warm and dry uniformly the fabric article. The ribs 34 may be longer than the slots themselves. Further in accordance with the present invention, the slots and ribs may also be located on the back side 36 (FIG. 2) of the rack assembly if desired.

Figure 2:
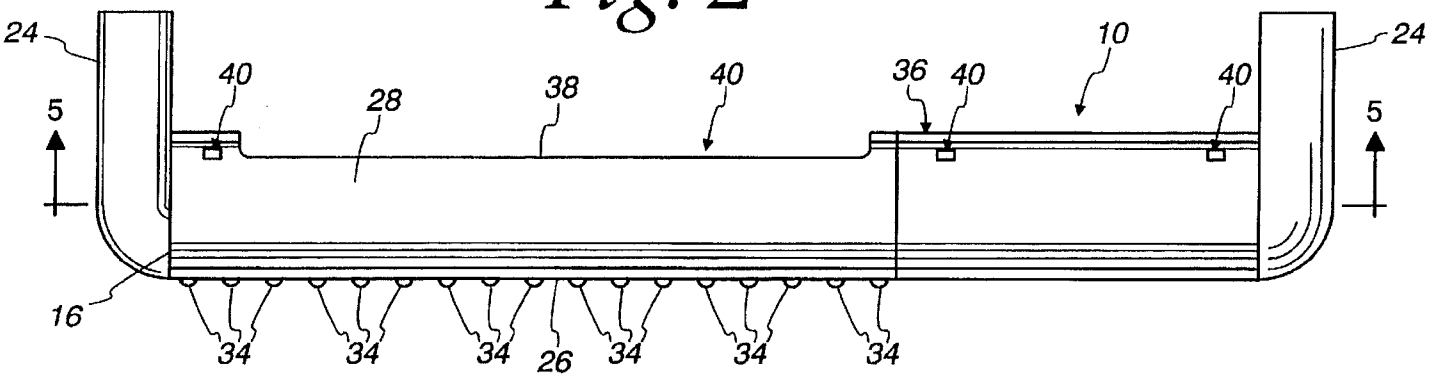
FIG. 2 is top view of the rack assembly according to the present invention.
Figure 3:
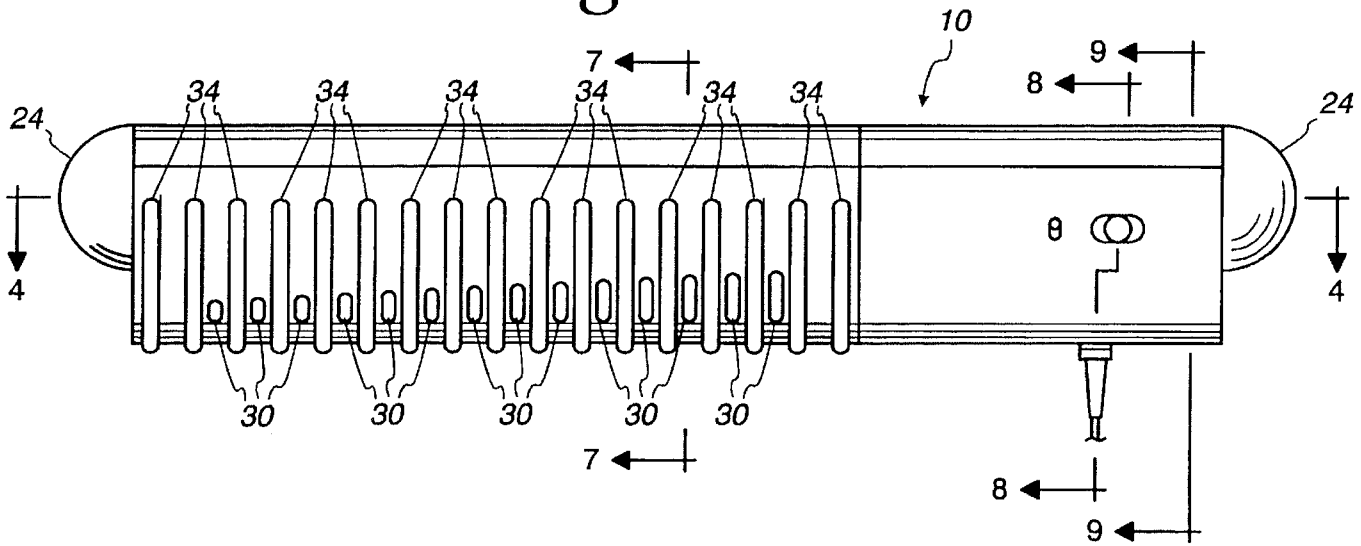
FIG. 3 is a front elevational view of the rack assembly of FIG. 2.
Figure 4:
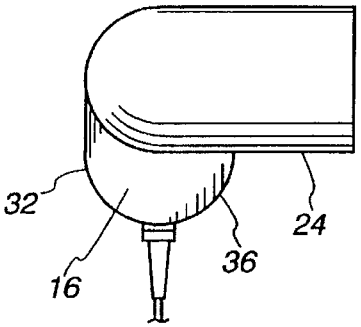
FIG. 4 is a elevational view taken from the right end of the rack assembly of FIG. 3.

Referring to FIGS. 2, 3 and 4, the removable wall mounts 24 extend perpendicular from the back side 36 of the rack assembly 10 for mounting to the assembly 10 at the preferred distance from the wall. As illustrated, the slots 30 and the ribs 34 only extend two-thirds of the length of the elongated tube 12 relative to the left end closure wall 16. The back side 36 of the elongated tube 12 may include a recessed portion 38 formed in both the bottom wall 26 and top cover 28 to correspond to the location of the slots 30 and ribs 34 on the front side 32 (FIG. 7). A plurality of lock tabs 40 for locking the top cover 28 to the bottom wall 26 will be describe in sufficient detail later.

Figure 5:
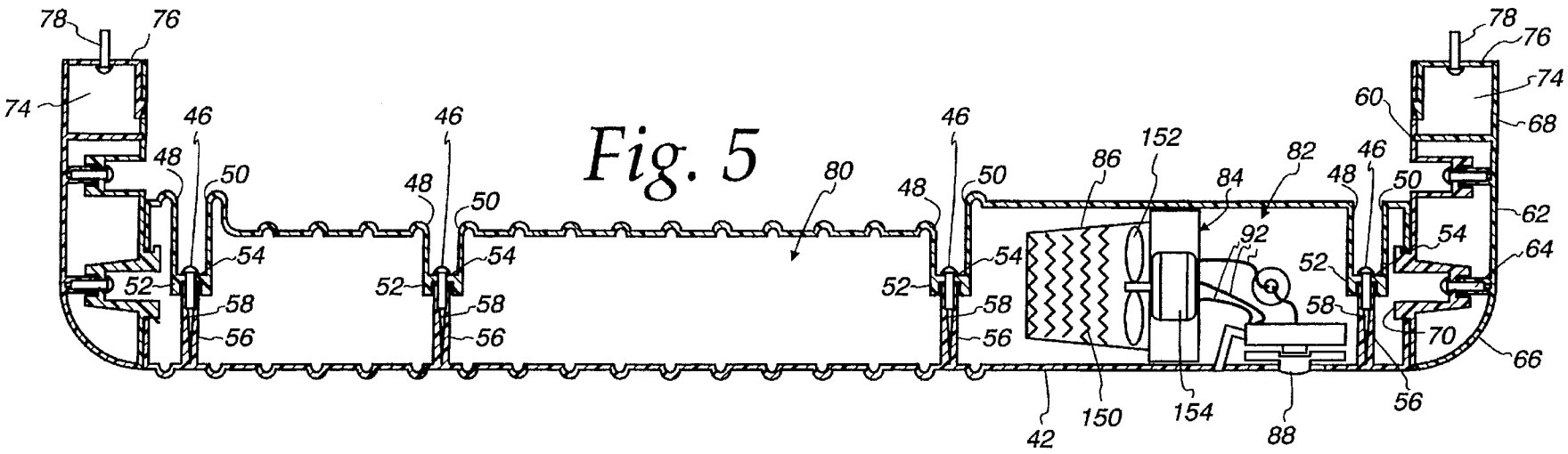
FIG. 5 is a cross-sectional view of the rack assembly taken along line 4—4 of FIG. 3.

Referring now to FIG. 5, the bottom wall 26 comprises an arcuate front wall 42 and an arcuate back wall 44, which are secured together by screws 46. The back wall 44 includes a plurality of recess wells, each being defined by side walls 48 and 50 and a bottom wall 52 which includes a screw opening 54. The front wall 42 includes a plurality pedestals 56 extending perpendicularly into the interior chamber 14 and being aligned with the recess wells. Each pedestal includes a center bore 58 for receiving the screw 46. This two part assembly aids in assembling the rack assembly 10 and in molding the bottom wall.

Each of the removable wall mounts 24 comprises a flat molded inner wall 60 and an arcuate molded outer wall 62, which are also secured together by screws 64 using a similar recess well and pedestal combination as above-described. Further, referring to FIGS. 1 and 5, each of the removable wall mounts 24 includes a rack assembly mounting end 66 and a wall mounting end 68. The recess well located at the rack assembly mounting end 66 is aligned with the opening 22 of the end walls, such as at the outer end wall 18 for illustration. The recess well includes a tubular wall or insert 70 that extends away from the removable wall mount 24 to be snugly received in the opening 24 for mounting it to the rack assembly 10. To lock the removable wall mount 24 at each end wall, each tubular wall 70 includes a tab 72 extending radially from the tubular wall 70 and adapted engage the inside of the end walls. For mounting the removable wall mounts 24, each opening 22 includes a tab opening 116 extending radially from the opening 22 toward the front side 32 of the rack assembly 10 and adapted to receive the tab 72. In mounting the removable wall mounts 24, each is first positioned perpendicular to the front side 32 of the rack assembly 10 to align the tab 72 with its tab opening 74 for inserting the tubular wall 70 into the opening 24. Once inserted, the removable wall mounts 24 are rotated 180 degrees to be positioned perpendicular to the back side 36 of the rack assembly 10 for locking with the tabs 72 against the inside surface of the end walls. The tab and tab opening may be positioned about the opening at the end wall at any location other than where the removable wall mounts extend perpendicular from the back side, but preferably they should be at least 90 degrees from the wall mounting position. Each of the tabs 72 are spaced a sufficient distance from their respective tubular wall 70 to create a groove between the left wall 60 and itself that tightly receives the end wall of the rack assembly 10.

Each of the removable wall mounts 24 further includes an interior chamber 74 at the wall mounting end 68 defined by the inner and outer walls 60 and 62 walls and having a transverse cross-section adapted to receive snugly a wall mount insert 76. Each of the wall mounted inserts 76 may be attached to the wall with screws 78 or glue.

Figure 6:
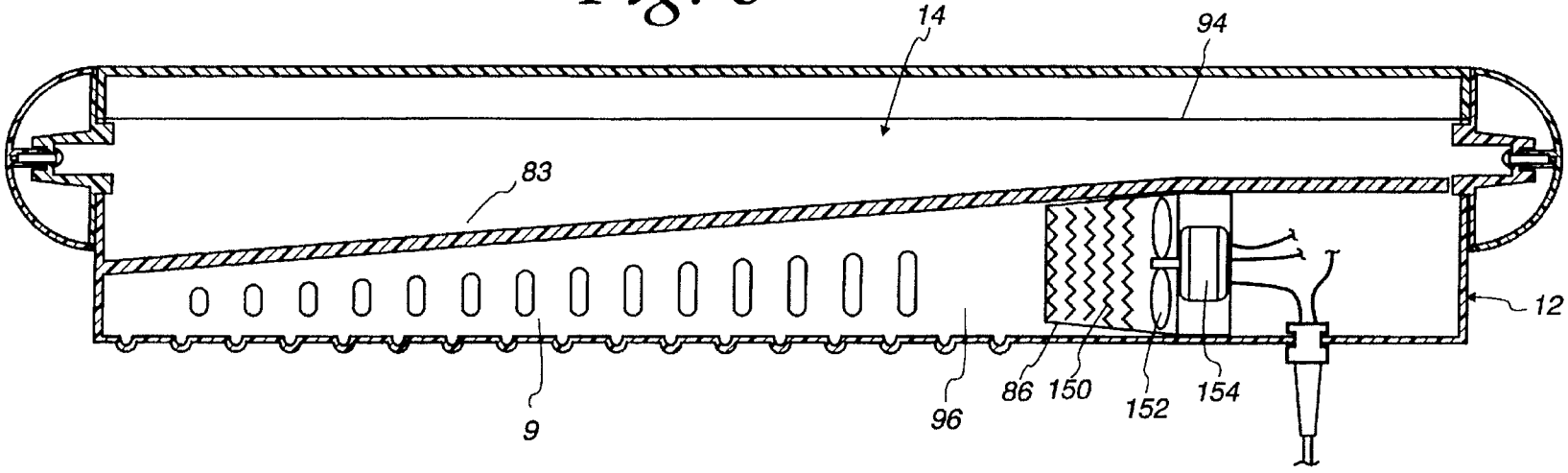
FIG. 6 is a cross-sectional view of the rack assembly taken along line 5—5 of FIG. 2.

Referring again to FIG. 5, the interior chamber comprises a left air distribution chamber 80 and a right mechanical component chamber 82, both being defined by the front and rear walls 42 and 44 and an intermediate air flow regulating wall 83 (FIG. 6). The air distribution chamber 80 cooperates with the intermediate air flow regulating wall 83 to distribute forced air uniformly through the elongated air vent slots 30.

The mechanical component chamber 82 houses a conventional electrical dryer assembly 84, similar to that of a conventional hair dryer, which includes an inverted funnel 86 in which is located electrical heating element 150 for warming the air and a fan 152 rotated by an electric motor 154 for directing the air through the funnel 86, which ultimately directs the air into the air distribution chamber 80. The dryer assembly may have voltage of 110/220 and wattage in the range of 1200 to 1600 watts, depending on the desired heating capacity. The electrical dryer assembly 84 may be mounted to the inside of either the front wall 62 or the back wall 44 defining the mechanical component chamber 82.

A two-way switch 88 is provided to turn the dryer assembly 84 "on" or "off", as desired. A conventional power cord 90 (FIG. 6) is also provided which may be plugged into a standard outlet to supply electrical power to the dryer assembly 84. Wires 92 are used to conventionally wire the components of the dryer assembly 84, the switch 88, the power cord 90 and any safety devices, such as safety breakers to protect against undesired power surges and the like. Alternatively, the dryer assembly may be powered by batteries (not shown) mounted inside the rack assembly 10 or located externally of the rack assembly 10.

Referring now to FIGS. 6 and 7, the interior chamber 14 of the elongated tube 12 is divided by the intermediate air flow regulating wall 83 into an upper rack mounting chamber 94 and a lower chamber 96 which comprises the air distribution chamber 80 and the mechanical component chamber 82. The intermediate air flow regulating wall 83 is a two-part wall comprising a first wall 98 extending perpendicularly from the front wall 42 into the interior chamber 14 and a second wall 100 extending perpendicularly from the back wall 44 into the interior chamber 14. With the first wall 98 extending farther into the interior chamber 14 than the second wall 100, the two walls 98 and 100 meet at a longitudinally extending parting line 102.

The upper rack mounting chamber 94 includes the portions of the end walls 16 and 18 having the openings 22 and provides an unobstructed path for the bar of an existing conventional towel to pass through it and the openings 22 for mounting the rack assembly 10 to an existing conventional towel rack.

The intermediate air flow regulating wall 83 angles downward from dryer assembly 84 to the left end wall 16 to progressively decrease the cross-sectional area of the lower chamber 96. The reduction of the cross-sectional area of the lower chamber 96 cooperates with the shortening length of the air vent slots 30 proceeding toward the left end wall 16 to aid in providing forced uniform air flow from the slots 30 along the entire length of the air distribution chamber 80 onto the fabric article. The angle of decent for the intermediate air flow regulating wall 83 must be coordinated with the desired length for the slots 30 and the capacity of the dryer assembly 84, which is further dependent upon the desired size of the rack assembly.

Referring to FIGS. 7–8, the top cover 28 is removable from the bottom wall 26 for associating both itself and bottom wall 26 with the bar of the existing towel rack to ultimately place the bar in the upper rack mounting chamber 94 and to extend the bar through the openings 22. The openings 22 at the end walls 16 and 18 are formed partially by the end walls of the top cover 28 and partially by the end walls of the bottom wall 26.

The front wall 42 and back wall 44 of the bottom wall 26 each have a wall upper mounting edge 104 and 106, respectively. The top cover 28 includes a front and rear mounting edge 108 and 110, respectively. The top cover 28 and the bottom wall 26 meet along a front and rear parting lines 112 and 114, respectively, and end wall parting lines 116 (FIG. 1).

To secure the top cover 28 to the bottom wall 26, the plurality of lock tabs 40 (FIG. 1) are spaced along and adjacent the rear parting line 114. As illustrated, at least three lock tabs 40 are preferred, with one near each end wall 16 and 18 and one intermediate the end walls 16 and 18 and over the mechanical components chamber 82. Each lock tab 40 has a L-like configuration with a horizontal leg 118 extending perpendicularly from the back mounting edge 106 into the upper rack mounting chamber 94 and a vertical leg 120 extending from an outer end 122 of the horizontal leg 118. The vertical leg 120 terminates with a hook 124 that is received in an opening 126 in the top cover 28 that is adjacent the top cover back mounting edge 110 and adapted to enable surfaces 128 of the hook 124 to cooperate with surfaces 130 defining the opening 126 to lock the top cover 28 to the bottom wall 26. An outer surface 132 of the hook 124 is profiled to match the upper outer surface 20 of the top cover 28.

Directly opposite each lock tab 40, the front mounting edge 106 of the bottom wall 26 includes a guide 134 for positioning the top cover 28 relative to the bottom wall 26 to prevent shifting when the top cover 28 is locked to the bottom wall 26. Each of the guides 134 extends into the upper rack mounting chamber 94 and then upward with an angled vertical leg that has a surface 138 profiled to match the interior of the top cover 28.

Referring to FIG. 8, intermediate the tabs 40 and over the mechanical components chamber 82 of the interior chamber 14, the top cover 28 and bottom wall 26 are associated and maintained by a tooth engagement indicated at 140 at the front parting line 112 and a guide engagement indicated at 142 at the rear parting line 114. The tooth engagement includes a tooth 144 formed at the top cover front mounting edge 108. The tooth 144 sits in a complementarily profiled tooth seat 146 that extends from the front mounting edge 104 of the front wall 42. The guide engagement at the rear parting line 114 is substantially similar in structure and function to that above described for guide 134 (FIG. 9) and is incorporated here. The tooth engagement and the guide engagement of FIG. 8 may extend over the entire length of the front and rear parting lines 112 and 114, respectively, between the tabs 40 and over the mechanical components chamber 82.

Referring to FIG. 7, over the air distribution chamber 80 of the interior chamber, the top cover 28 and the bottom wall 26 are associated and maintained by a guide engagement indicated at 148 at front parting line 112 and is substantially similar in structure and function to that above-described for guide 134 (FIG. 9) and is incorporated here. The guide engagement indicated at 148 may extend along the entire length of the parting 112 over the air distribution chamber 80.

Figure 10:
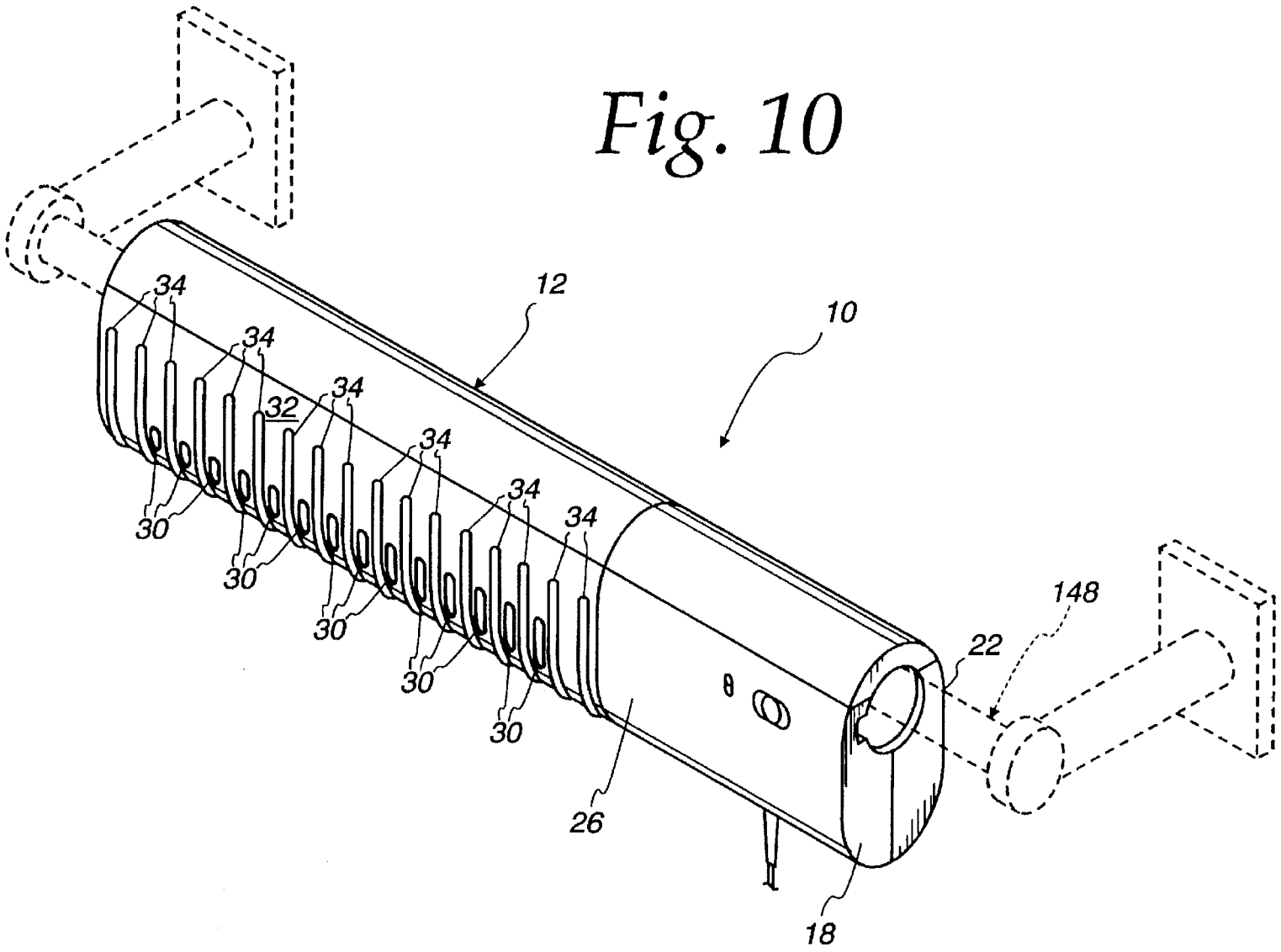
FIG. 10 is a perspective view of the rack assembly of FIG. 1 employing a rack bar for mounting to a support panel.

As illustrated in FIG. 10, a conventional rack bar 148 is shown supporting the rack assembly. More particularly, the rack bar 148 extends through the elongated tube 12 and the openings 22.

All of the above-described wall components and there respective structure may be molded from plastic, such as a polycarbonate, such as Lexan®, a product by General Electric.

It will be understood that various changes in the details, materials and arrangement of parts and systems which have been herein described and illustrated in order to explain the nature of the invention may be made by those skilled in the art within the principle and scope of the invention as expressed in the appended claims.

What is claimed is:

1. A rack assembly mountable to a support panel for drying fabric articles hung thereover with air comprising:

an elongated tube having a first end wall, a second end wall opposite the first end wall, an outer surface capable of supporting the fabric article and a plurality of slots in the elongated tube and extending through the outer surface for directing the air outward;

an electric heating element mounted within said tube for warming the air;

a fan mounted within said tube for directing the air over the electric heating element and toward the second end wall over the plurality of slots to force the air to exit the elongated tube and onto the fabric article;

an electric motor for driving the fan; and a first end cap located substantially outside the elongated tube at the first end wall of the elongated tube and a second end cap located substantially outside the elongated tube at the second end wall of the elongated tube, the first end cap being engaged with the first end wall and the second end cap being engaged with the second end wall, each of the end caps being extendable laterally from the elongated tube and mountable to a support panel for mounting the rack assembly at an elevated position for enabling the fabric article to be suspended from the elongated tube adjacent the plurality of slots for drying.

2. A rack assembly in accordance with claim 1 further comprising a first and second wall bracket capable of being mounted to the support panel and adapted to engage the first and second end caps respectively; and means for securing the first and second end caps to the first and second wall brackets to prevent release.

3. A rack assembly mountable to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and toward the second end wall over the plurality of slots to force the air to exit the interior chamber and onto the fabric article;

an electric motor for driving the fan;

means for mounting the elongated tube to a support panel at an elevated position for enabling the fabric article to be suspended from the elongated tube adjacent the plurality of slots for drying; and the means for mounting further comprising:

a first end cap located substantially outside the elongated tube mounted at the first end wall of the elongated tube and a second end cap located substantially outside the elongated tube mounted at the second end wall of the elongated tube, each of the end caps mounted to extend laterally from the elongated tube;

a first and second wall bracket capable of being mounted to the support panel and adapted to engage the first and second end caps respectively; and means for securing the first and second end caps to the first and second wall brackets to prevent release.

4. A rack assembly mountable to a support panel for drying fabric articles hung thereover with air comprising:

an elongated tube having spaced ends, a first end wall at one of the ends, a second end wall at the second end, an interior chamber in the tube substantially closed by the end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and to the plurality of slots;

an electric motor for driving the fan;

means for mounting the elongated tube to a support panel at an elevated position for enabling the fabric article to be suspended from the elongated tube adjacent the plurality of slots for drying;

the interior chamber having a generally linear longitudinal axis extending from the fan across the plurality of slots, the fan blowing the air along one general path, the one general path being predominately about the generally linear longitudinal axis to force the air to exit the interior chamber through the plurality of slots, and the air impacting the second end wall to further force the air to exit the interior chamber through the plurality of slots; and an air directing wall located in the interior chamber at the fan, the wall being about the generally linear longitudinal axis and tapering toward the generally linear longitudinal axis away from the fan to direct the air along the one general path to force the air to exit the interior chamber through the plurality of slots.

5. A rack assembly mountable to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward, the plurality of slots being elongated slots spaced longitudinally along the elongated tube and varying in length becoming shorter from the first end wall to the second end wall;

an electric heating element located in the interior chamber for warming the air;

a fan located in the interior chamber for directing the air over the electric heating element and toward the second end wall over the plurality of slots to force the air to exit the interior chamber and onto the fabric article, the fan being adjacent the first end wall;

an electric motor for driving the fan;

a divider wall extending longitudinally through the interior chamber toward the second end wall, the divider wall reducing the cross-section of the interior chamber to force the air through the plurality of slots to exit the interior chamber; and means for mounting the elongated tube to a support panel at an elevated position for enabling the fabric article to be suspended from the elongated tube adjacent the plurality of slots for drying.

6. A rack assembly in accordance with claim 5 wherein the elongated tube further comprises a plurality of ribs spaced longitudinally therealong and extending outward from the outer surface for spacing the fabric article from the elongated slots.

7. A rack assembly mountable to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and toward the second end wall over the plurality of slots to force the air to exit the interior chamber and onto the fabric article, the fan being adjacent the first end wall;

an electric motor for driving the fan;

means for mounting the elongated tube to a support panel at an elevated position for enabling the fabric article to be suspended from the elongated tube adjacent the plurality of slots for drying; and a divider wall extending longitudinally through the interior chamber from the fan toward the second end wall, the divider wall reducing the cross-section of the interior chamber to facilitate forced flow of the air through plurality of slots.

8. A rack assembly in accordance with claim 7 wherein the plurality of slots are elongated slots spaced longitudinally along the elongated tube.

9. A rack assembly mountable to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and toward the second end wall over the plurality of slots to force the air to exit the interior chamber and onto the fabric article;

an electric motor for driving the fan;

means for mounting the elongated tube to a support panel at an elevated position for enabling the fabric article to be suspended from the elongated tube adjacent the plurality of slots for drying;

the means for mounting further comprising:

a first end cap mounted at the first end wall of the elongated tube and a second end cap mounted at the second end wall of the elongated tube, each of the end caps mounted to extend laterally from the elongated tube;

a first and second wall bracket capable of being mounted to the support panel and adapted to engage the first and second end caps respectively; and the means for securing further comprising:

each of the first and second end caps having an end cap interior surface, the end cap interior surface defining an interior end cap chamber; and each of the first and second wall brackets having an exterior surface complementarily configured for allowing the first and second end caps to slide on the respective wall bracket, whereby each of the first and second wall brackets at least partially resides in the respective first and second end cap interior chamber with the respective first and second end cap interior surface engaging the respective exterior surface of the respective wall bracket to prevent release.

10. A rack assembly mountable to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and toward the second end wall over the plurality of slots to force the air to exit the interior chamber and onto the fabric article;

an electric motor for driving the fan;

means for mounting the elongated tube to a support panel at an elevated position for enabling the fabric article to be suspended from the elongated tube adjacent the plurality of slots for drying; and the means for mounting further comprising:

a first end cap at the first end wall of the elongated tube and a second end cap at the second end wall of the elongated tube;

a first and second wall bracket mounted to the support panel for securing the first end cap and second end cap to the support panel; and a pair of pivotable mounts for mounting each of the first and second end caps to the first and second end walls of the elongated tube respectively, the pivotable mounts allowing each end cap to rotate from a first position in which the end cap is locked and positioned laterally from the elongated tube for receiving the wall bracket to a second position in which the end cap is free to slide relative to the elongated tube for removing the end cap.

11. A rack assembly in accordance with claim 10 in which the pivotable mounts allow at least 90 degrees of rotation to enable each end cap to be rotated between the first and second positions.

12. A rack assembly mountable to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and toward the second end wall over the plurality of slots to force the air to exit the interior chamber and onto the fabric article;

an electric motor for driving the fan;

means for mounting the elongated tube to a support panel at an elevated position for enabling the fabric article to be suspended from the elongated tube adjacent the plurality of slots for drying; and the means for mounting further comprising:

a rack bar mounted to the support panel for supporting the rack assembly;

a top cover having a top exterior surface capable of supporting the fabric article, a first cover end wall and a second cover end wall, each of the first and second cover end walls defining an opening;

each of the first and second end walls of the elongated tube defining an opening that cooperates with the openings of the first and second cover end walls of the top cover to form openings in the rack assembly, and the rack bar extending longitudinally through the rack assembly and out the openings in the assembly when supporting the rack assembly.

13. A rack assembly in accordance with claim 12 wherein the top cover is removable for placing the rack bar through the rack assembly and out the openings of the rack assembly and includes means for securing the top cover to the rack assembly and for releasing the top cover from the rack assembly.

14. A rack assembly in accordance with claim 13 wherein the means for securing and releasing the top cover from the rack assembly comprises:

the top cover having a pair of cover edges;

the elongated tube having a pair of tube edges, the tube edges are aligned with the cover edges when the cover is secured to the elongated tube;

at least one alignment tab extending adjacently from one of the tube edges and at least one locking tab extending adjacently from the other tube edge and having means for locking the cover to the elongated tube; and at least one slot located adjacent one of the cover edges for receiving the at least one tab to align the cover with the elongated tube and to prevent shifting of the cover relative to the elongated tube.

15. A rack assembly in accordance with claim 12 wherein the at least one alignment tab includes three alignment tabs, the at least one locking tab includes three locking tabs and the at least one slot includes three slots.

16. A rack assembly mountable to a support panel for drying fabric articles hung thereover with air comprising:

an elongated tube having a first end wall, a second end wall opposite the first end wall, an outer surface capable of supporting the fabric article and a plurality of slots in the elongated tube and extending through the outer surface for directing the air outward;

an electric heating element mounted within said tube for warming the air;

a fan mounted within said tube for directing the air over the electric heating element and toward the second end wall over the plurality of slots to force the air to exit the elongated tube and onto the fabric article;

an electric motor for driving the fan;

a first end cap at the first end wall of the elongated tube and a second end cap at the second end wall of the elongated tube, each of the end caps being extendable laterally from the elongated tube and mountable to a support panel for mounting the rack assembly at an elevated position for enabling the fabric article to be suspended from the elongated tube adjacent the plurality of slots for drying; and a pair of pivotable mounts for mounting each of the first and second end caps at the first and second end walls of the elongated tube respectively, the first and second end walls each defining mounting apertures, the mounting apertures further defining at least one keyway aperture, the first and second end caps each having at least one tab, and the pivotable mounts allowing each end cap to rotate from a first position in which the tab of the end cap is disposed from the keyway to lock the end cap and to position the end cap laterally from the elongated tube to a second position in which the tab of the end cap is located at the keyway for the end cap to slide relative to the elongated tube for removing the end cap.

17. A rack assembly in accordance with claim 16 in which the pivotable mounts allow at least 120 degrees of rotation to enable each end cap to be rotated between the first and second positions.

18. A rack assembly mountable to a support panel for drying fabric articles hung thereover with air comprising:

an elongated tube having a first end wall, a second end wall opposite the first end wall, an outer surface capable of supporting the fabric article and a plurality of slots in the elongated tube and extending through the outer surface for directing the air outward;

an electric heating element located within said tube for warming the air;

a fan located within said tube for directing the air over the electric heating element and toward the second end wall over the plurality of slots to force the air to exit the elongated tube and onto the fabric article;

an electric motor for driving the fan; and a first end cap at the first end wall of the elongated tube and a second end cap at the second end wall of the elongated tube, each of the end caps being extendable laterally from the elongated tube and mountable to a support panel for mounting the rack assembly at an elevated position for enabling the fabric article to be suspended from the elongated tube adjacent the plurality of slots for drying;

a first and second wall bracket capable of being mounted to the support panel and adapted to engage the first and second end caps respectively; and means for securing the first and second end caps to the first and second wall brackets to prevent release, the means for securing further comprising:

each of the first and second end caps having an end cap interior surface, the end cap interior surface defining an interior end cap chamber; and each of the first and second wall brackets having an exterior surface complementarily configured for allowing the first and second end caps to slide on the respective wall bracket, whereby each of the first and second wall brackets at least partially resides in the respective first and second end cap interior chamber with the respective first and second end cap interior surface engaging the respective exterior surface of the respective wall bracket to prevent release.

19. A rack assembly mountable to a support panel for drying fabric articles hung thereover with air comprising:

an elongated tube having a first end wall, a second end wall opposite the first end wall, an outer surface capable of supporting the fabric article and a plurality of slots in the elongated tube and extending through the outer surface for directing the air outward;

an electric heating element for warming the air;

a fan for directing the air over the electric heating element and toward the second end wall over the plurality of slots to force the air to exit the elongated tube and onto the fabric article;

an electric motor for driving the fan; and a rack bar mounted to a support panel and extending through the rack assembly for mounting the rack assembly at an elevated position for enabling the fabric article to be suspended from the elongated tube adjacent the plurality of slots for drying.

20. A rack assembly in accordance with claim 19 further comprising:

a cover having an exterior surface capable of supporting the fabric article, a first cover end wall and a second cover end wall, each of the first and second cover end walls having an opening; and each of the first and second end walls of the elongated tube having an opening that cooperates with the openings of the first and second cover end walls of the cover to form openings in the rack assembly, and the rack bar extending longitudinally through the rack assembly and out the openings in the assembly when supporting the rack assembly.

21. A rack assembly in accordance with claim 20 wherein the cover is removable for placing the rack bar through the rack assembly and out the openings of the rack assembly and includes means for securing the cover to the rack assembly and releasing the cover from the rack assembly.

22. A rack assembly in accordance with claim 21 wherein the means for securing the cover to the rack assembly and for releasing the cover from the rack assembly comprises:

the cover having a pair of cover edges;

the elongated tube having a pair of tube edges, the tube edges are aligned with the cover edges when the cover is secured to the elongated tube;

at least one alignment tab extending adjacently from one of the tube edges and at least one locking tab extending adjacently from the other tube edge and having means for locking the cover to the elongated tube; and at least one slot located adjacent one of the cover edges for receiving the at least one tab to align the cover with the elongated tube and to prevent shifting of the cover relative to the elongated tube.

23. A rack assembly in accordance with claim 22 wherein the at least one alignment tab includes three alignment tabs, the at least one locking tab includes three locking tabs and the at least one slot includes three slots.

24. A rack assembly mounted to a support panel for drying fabric articles hung thereover with air comprising:

an elongated tube having spaced ends, a first end wall at one of the ends, a second end wall at the second end, an interior chamber in the tube substantially closed by the end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and to the plurality of slots;

an electric motor for driving the fan;

a support panel;

means for mounting the elongated tube to the support panel at an elevated position for enabling the fabric article to be suspended from the elongated tube adjacent the plurality of slots for drying;

the interior chamber having a generally linear longitudinal axis extending from the fan across the plurality of slots, the fan blowing the air along one general path, the one general path being predominately about the generally linear longitudinal axis to force the air to exit the interior chamber through the plurality of slots, the air impacting the second end wall to further force the air to exit the interior chamber through the plurality of slots; and an air directing wall located in the interior chamber at the fan, the wall being about the generally linear longitudinal axis and tapering toward the generally linear longitudinal axis away from the fan to direct the air predominately alone the one general path to force the air to exit the interior chamber through the plurality of slots.

25. A rack assembly mounted to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and toward the second end wall over the plurality of slots to force the air to exit the interior chamber and onto the fabric article, the fan being adjacent the first end wall;

an electric motor for driving the fan;

a support panel;

means for mounting the elongated tube to the support panel at an elevated position for enabling the fabric article to be suspended from the elongated tube adjacent the plurality of slots for drying; and a divider wall extending longitudinally through the interior chamber from the fan toward the second end wall, the divider wall reducing the cross-section of the interior chamber to facilitate forced flow of the air through the plurality of slots.

26. A rack assembly in accordance with claim 25 wherein the plurality of slots are elongated slots spaced longitudinally along the elongated tube.

27. A rack assembly mounted to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward, the plurality of slots being elongated slots spaced longitudinally along the elongated tube and varying in length becoming shorter proceeding from the first end wall to the second end wall;

an electric heating element located in the interior chamber for warming the air;

a fan located in the interior chamber for directing the air over the electric heating element and toward the second end wall over the plurality of slots to force the air to exit the interior chamber and onto the fabric article, the fan being adjacent the first end wall;

an electric motor for driving the fan;

a divider wall extending longitudinally through the interior chamber toward the second end wall for reducing the cross-section of the interior chamber to facilitate forced flow of the air through the plurality of slots;

a support panel; and means for mounting the elongated tube to the support panel at an elevated position for enabling the fabric article to be suspended from the elongated tube adjacent the plurality of slots for drying.

28. A rack assembly in accordance with claim 27 wherein the elongated tube further comprises a plurality of ribs spaced longitudinally therealong and extending outward from the outer surface for spacing the fabric article from the elongated slots.

29. A rack assembly mounted to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and toward the second end wall over the plurality of slots to force the air to exit the interior chamber and onto the fabric article;

an electric motor for driving the fan;

a support panel;

means for mounting the elongated tube to the support panel at an elevated position for enabling the fabric article to be suspended from the elongated tube adjacent the plurality of slots for drying; and the means for mounting further comprising:

a first end cap mounted at the first end wall of the elongated tube and a second end cap mounted at the second end wall of the elongated tube, each of the end caps mounted to extend laterally from the elongated tube;

a first and second wall bracket capable of being mounted to the support panel and adapted to engage the first and second end caps respectively; and means for securing the first and second end caps to the first and second wall brackets to prevent release.

30. A rack assembly in accordance with claim 29 wherein the means for securing further comprises:

each of the first and second end caps having an end cap interior surface, the end cap interior surface defining an interior end cap chamber; and each of the first and second wall brackets having an exterior surface complementarily configured for allowing the first and second end caps to slide on the respective wall bracket, whereby each of the first and second wall brackets at least partially resides in the respective first and second end cap interior chamber with the respective first and second end cap interior surface engaging the respective exterior surface of the respective wall bracket to prevent release.

31. A rack assembly mounted to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and toward the second end wall over the plurality of slots to force the air to exit the interior chamber and onto the fabric article;

an electric motor for driving the fan;

a support panel;

means for mounting the elongated tube to the support panel at an elevated position for enabling the fabric article to be suspended from the elongated tube adjacent the plurality of slots for drying; and the means for mounting further comprising:

a first end cap at the first end wall of the elongated tube and a second end cap at the second end wall of the elongated tube;

a first and second wall bracket mounted to the support panel for securing the first end cap and the second end cap to the support panel; and a pair of pivotable mounts for mounting each of the first and second end caps to the first and second end walls of the elongated tube respectively, the pivotable mounts allowing each end cap to rotate from a first position in which the end cap is locked and positioned laterally from the elongated tube for receiving the wall bracket to a second position in which the end cap is free to slide relative to the elongated tube for removing the end cap.

32. A rack assembly in accordance with claim 31 in which the pivotable mounts allow at least 90 degrees of rotation to enable each end cap to be rotated between the first and second positions.

33. A rack assembly mounted to a support panel for drying fabric articles hung thereover with air comprising:

an elongated tube having a first end wall, a second end wall opposite the first end wall, an interior chamber located between the first and second end walls, an outer surface capable of supporting the fabric article and a plurality of slots in the elongated tube and extending through the outer surface for directing the air outward;

an electric heating element located in the interior chamber for warming the air;

a fan located in the interior chamber for directing the air over the electric heating element and toward the second end wall over the plurality of slots to force the air to exit the interior chamber and onto the fabric article;

an electric motor for driving the fan;

a support panel;

means for mounting the elongated tube to the support panel at an elevated position for enabling the fabric article to be suspended from the elongated tube adjacent the plurality of slots for drying; and the means for mounting further comprising:

a rack bar mounted to the support panel for supporting the rack assembly;

a top cover having a top exterior surface capable of supporting the fabric article, a first cover end wall and a second cover end wall, each of the first and second cover end walls defining an opening;

each of the first and second end walls of the elongated tube defining an opening that cooperates with the openings of the first and second cover end walls of the top cover to form openings in the rack assembly, and the rack bar extending longitudinally through the rack assembly and out the openings in the assembly when supporting the rack assembly.

34. A rack assembly in accordance with claim 33 wherein the top cover is removable for placing the rack bar through the rack assembly and out the openings of the rack assembly and includes means for securing the top cover to the rack assembly and for releasing the top cover from the rack assembly.

35. A rack assembly in accordance with claim 34 wherein the means for securing and releasing the top cover from the rack assembly comprises:

the top cover having a pair of cover edges;

the elongated tube having a pair of tube edges, the tube edges are aligned with the cover edges when the cover is secured to the elongated tube;

at least one alignment tab extending adjacently from one of the tube edges and at least one locking tab extending adjacently from the other tube edge and having means for locking the cover to the elongated tube; and at least one slot located adjacent one of the cover edges for receiving the at least one tab to align the cover with the elongated tube and to prevent shifting of the cover relative to the elongated tube.

36. A rack assembly in accordance with claim 35 wherein the at least one alignment tab includes three alignment tabs, the at least one locking tab includes three locking tabs and the at least one slot includes three slots.

37. A rack assembly mounted to a support panel for drying fabric articles hung thereover with air comprising:

an elongated tube having a first end wall, a second end wall opposite the first end wall, an outer surface capable of supporting the fabric article and a plurality of slots in the elongated tube and extending through the outer surface for directing the air outward;

an electric heating element for warming the air;

a fan located within the tube for directing the air over the electric heating element and toward the second end wall over the plurality of slots to force the air to exit the elongated tube and onto the fabric article;

an electric motor for driving the fan;

a support panel; and a first end cap located substantially outside the elongated tube at the first end wall of the elongated tube and a second end cap located substantially outside the elongated tube at the second end wall of the elongated tube, the first end cap being engaged with the first end wall and the second end cap being engaged with the second end wall, each of the end caps being extendable laterally from the elongated tube and mountable to a support panel for mounting the rack assembly at an elevated position for enabling the fabric article to be suspended from the elongated tube adjacent the plurality of slots for drying.

38. A rack assembly in accordance with claim 37 further comprising a first and second wall bracket capable of being mounted to the support panel and adapted to engage the first and second end caps respectively; and means for securing the first and second end caps to the first and second wall brackets to prevent release.

39. A rack assembly mounted to a support panel for drying fabric articles hung thereover with air comprising:

an elongated tube having a first end wall, a second end wall opposite the first end wall, an outer surface capable of supporting the fabric article and a plurality of slots in the elongated tube and extending through the outer surface for directing the air outward;

an electric heating element for warming the air;

a fan for directing the air over the electric heating element and toward the second end wall over the plurality of slots to force the air to exit the elongated tube and onto the fabric article;

an electric motor for driving the fan;

a support panel; and a first end cap at the first end wall of the elongated tube and a second end cap at the second end wall of the elongated tube, each of the end caps being extendable laterally from the elongated tube and mountable to the support panel for mounting the rack assembly at an elevated position for enabling the fabric article to be suspended from the elongated tube adjacent the plurality of slots for drying; and a pair of pivotable mounts for mounting each of the first and second end caps at the first and second end walls of the elongated tube respectively, the pivotable mounts allowing each end cap to rotate from a first position in which the end cap is locked and positioned laterally from the elongated tube to a second position in which the end cap is free to slide relative to the elongated tube for removing the end cap.

40. A rack assembly in accordance with claim 39 in which the pivotable mounts allow at least 120 degrees of rotation to enable each end cap to be rotated between the first and second positions.

41. A rack assembly mounted to a support panel for drying fabric articles hung thereover with air comprising:

an elongated tube having a first end wall, a second end wall opposite the first end wall, an outer surface capable of supporting the fabric article and a plurality of slots in the elongated tube and extending through the outer surface for directing the air outward;

an electric heating element for warming the air;

a fan for directing the air over the electric heating element and toward the second end wall over the plurality of slots to force the air to exit the elongated tube and onto the fabric article;

an electric motor for driving the fan;

a support panel;

a first end cap at the first end wall of the elongated tube and a second end cap at the second end wall of the elongated tube, each of the end caps being extendable laterally from the elongated tube and mountable to the support panel for mounting the rack assembly at an elevated position for enabling the fabric article to be suspended from the elongated tube adjacent the plurality of slots for drying;

a first and second wall bracket capable of being mounted to the support panel and adapted to engage the first and second end caps respectively; and means for securing the first and second end caps to the first and second wall brackets comprising:

each of the first and second end caps having an end cap interior surface, the end cap interior surface defining an interior end cap chamber; and each of the first and second wall brackets having an exterior surface complementarily configured for allowing the first and second end caps to slide on the respective wall bracket, whereby each of the first and second wall brackets at least partially resides in the respective first and second end cap interior chamber with the respective first and second end cap interior surface engaging the respective exterior surface of the respective wall bracket to prevent release.

42. A rack assembly mounted to a support panel for drying fabric articles hung thereover with air comprising:

an elongated tube having a first end wall, a second end wall opposite the first end wall, an outer surface capable of supporting the fabric article and a plurality of slots in the elongated tube and extending through the outer surface for directing the air outward;

an electric heating element for warming the air;

a fan for directing the air over the electric heating element and toward the second end wall over the plurality of slots to force the air to exit the elongated tube and onto the fabric article;

an electric motor for driving the fan;

a support panel; and a rack bar mounted to the support panel and extending through the rack assembly for mounting the rack assembly at an elevated position for enabling the fabric article to be suspended from the elongated tube adjacent the plurality of slots for drying.

43. A rack assembly in accordance with claim 42 further comprising:

a cover having an exterior surface capable of supporting the fabric article, a first cover end wall and a second cover end wall, each of the first and second cover end walls having an opening; and each of the first and second end walls of the elongated tube having an opening that cooperates with the openings of the first and second cover end walls of the cover to form openings in the rack assembly, and the rack bar extending longitudinally through the rack assembly and out the openings in the assembly when supporting the rack assembly.

44. A rack assembly in accordance with claim 43 wherein the cover is removable for placing the rack bar through the rack assembly and out the openings of the rack assembly and includes means for securing the cover to the rack assembly and releasing the cover from the rack assembly.

45. A rack assembly in accordance with claim 44 wherein the means for securing the cover to the rack assembly and for releasing the cover from the rack assembly comprises:

the cover having a pair of cover edges;

the elongated tube having a pair of tube edges, the tube edges are aligned with the cover edges when the cover is secured to the elongated tube;

at least one alignment tab extending adjacently from one of the tube edges and at least one locking tab extending adjacently from the other tube edge and having means for locking the cover to the elongated tube; and at least one slot located adjacent one of the cover edges for receiving the at least one tab to align the cover with the elongated tube and to prevent shifting of the cover relative to the elongated tube.

46. A rack assembly in accordance with claim 45 wherein the at least one alignment tab includes three alignment tabs, the at least one locking tab includes three locking tabs and the at least one slot includes three slots.

47. A rack assembly mounted to a support panel for drying fabric articles hung thereover with air comprising:

an elongated tube having a first end wall, a second end wall opposite the first end wall, a plurality of slots in the elongated tube and extending through the outer surface for directing the air outward, and a cover, the cover having an exterior surface capable of supporting the fabric article, a first cover end wall and a second cover end wall, each of the first and second cover end walls having an opening;

each of the first and second end walls of the elongated tube having an opening that cooperates with the openings of the first and second cover end walls of the cover to form openings in the rack assembly, and the rack bar extending longitudinally through the rack assembly and out the openings in the assembly when supporting the rack assembly;

an electric heating element for warming the air;

a fan for directing the air over the electric heating element and toward the second end wall over the plurality of slots to force the air to exit the elongated tube onto the fabric article;

an electric motor for driving the fan;

a support panel; and a rack bar mounted to the support panel and extending through the rack assembly at an elevated position for enabling the fabric article to be suspended from the elongated tube adjacent the plurality of slots for drying.

48. A rack assembly in accordance with claim 47 wherein the cover is removable for placing the rack bar through the rack assembly and includes means for securing the cover to the rack assembly and releasing the cover from the rack assembly.

* * * * *